US009334669B1

(12) United States Patent
Byndon

(10) Patent No.: US 9,334,669 B1
(45) Date of Patent: May 10, 2016

(54) KEEPSAKE PLAQUE FOR CREMATED REMAINS

(71) Applicant: Larry T. Byndon, St. Louis, MO (US)

(72) Inventor: Larry T. Byndon, St. Louis, MO (US)

( * ) Notice: Subject to any disclaimer, the term of this patent is extended or adjusted under 35 U.S.C. 154(b) by 0 days.

(21) Appl. No.: 14/671,267

(22) Filed: Mar. 27, 2015

(51) Int. Cl.
*E04H 13/00* (2006.01)
*A61G 99/00* (2006.01)
*A61G 17/08* (2006.01)

(52) U.S. Cl.
CPC ..... *E04H 13/008* (2013.01); *A61G 17/08* (2013.01); *A61G 99/00* (2013.01)

(58) Field of Classification Search
CPC ..... A61G 17/08; A61G 99/00; B44C 5/04; B44C 5/0446; E04H 13/008
USPC ..... 27/1; 40/124.5, 722; 428/913.3, 542.4
See application file for complete search history.

(56) References Cited

U.S. PATENT DOCUMENTS

| | | | | |
|---|---|---|---|---|
| D374,963 | S | 10/1996 | Neuberger et al. | |
| 5,625,933 | A | 5/1997 | Neuberger et al. | |
| 5,875,528 | A * | 3/1999 | Parker | 27/1 |
| 5,950,288 | A | 9/1999 | Bach Lahor | |
| 6,023,822 | A * | 2/2000 | Luebke | 27/1 |
| 6,557,222 | B2 * | 5/2003 | Groemminger et al. | 27/10 |
| 6,665,916 | B1 | 12/2003 | Santorello | |
| D492,079 | S | 6/2004 | Feltman | |
| 6,775,886 | B2 * | 8/2004 | Ogle, II | A61G 17/08 27/1 |
| 6,785,938 | B1 * | 9/2004 | Johansen, Jr. | 27/1 |
| 7,082,653 | B1 | 8/2006 | Sueppel | |
| 7,191,499 | B2 | 3/2007 | Davis et al. | |
| 7,370,394 | B1 * | 5/2008 | Juneau | 27/1 |
| 7,373,703 | B1 | 5/2008 | Grenci | |
| 7,861,385 | B1 * | 1/2011 | Meyer | 27/1 |
| 7,950,118 | B1 * | 5/2011 | Fumo | 27/1 |
| 8,336,174 | B1 * | 12/2012 | Johnson | 27/1 |
| 8,341,812 | B2 * | 1/2013 | Kocir | 27/1 |
| 8,499,425 | B2 * | 8/2013 | Roberts | 27/1 |
| 2005/0120525 | A1 * | 6/2005 | Heil et al. | 27/1 |
| 2007/0152549 | A1 | 7/2007 | Champagne | |
| 2007/0220788 | A1 * | 9/2007 | McCray | 40/124.5 |
| 2009/0056090 | A1 | 3/2009 | Bunk | |
| 2010/0058565 | A1 * | 3/2010 | Roberts | 27/1 |
| 2010/0212124 | A1 * | 8/2010 | Denton | A01K 85/01 27/1 |
| 2014/0182096 | A1 * | 7/2014 | Jairala, Jr. | 27/1 |
| 2015/0013123 | A1 * | 1/2015 | Lynch | 27/1 |

* cited by examiner

*Primary Examiner* — William Miller
(74) *Attorney, Agent, or Firm* — Grace J. Fishel

(57) ABSTRACT

A memorial plaque for a divided portion of the cremated remains in a zip bag of a deceased person, said memorial plaque having a cavity into which the zip bag is received and sealingly closed with a cover. A front face of the memorial plaque adapted to be custom personalized with the person or pet's name or other copy significant to the recipient. In use the cavity and cover faces a support surface such that the memorial plaque does not draw attention to its contents, making it suitable for display in home or office.

6 Claims, 4 Drawing Sheets

KEEPSAKE PLAQUE FOR CREMATED REMAINS

BACKGROUND OF THE INVENTION

1. Field of the Invention

The present invention relates to a plaque for holding a portion of cremated remains of a deceased loved one or pet. The plaque is very discrete as to its contents, making it suitable for display in home or office.

2. Brief Description of the Prior Art

Cremation is on the rise driven in part by a tougher economy causing many more families to choose cremation. Cremated remains are usually delivered to the family in an urn or box. According to the Cremation Association of North America, one third of people who received cremated remains bury them, one third keep them and the last third scatter them. Each of these methods is place dependent and does not satisfy the needs of family members who are dispersed. Hence for some families there is an emotional need to divide the ashes.

The recipient of a divided part of the cremated remains may scatter or bury the ashes. For those who keep the ashes there are small decorative urns into which the divided ashes may be placed or cremation jewelry with a small inner chamber for ashes. Many people, however, are squeamish about cremated remains. Visitors in a home or office may feel uncomfortable around even a small urn and some people may be uncomfortable around a person wearing cremation jewelry.

There are memorial plaques for outdoor or indoor placement identifying the deceased which do not contain ashes and there are plaques attached to memorial urns for indoor use, the latter of which keep the ashes nearby. What is needed, however, is a receptacle for a divided portion of the cremated remains that is discrete about its contents, not a memento mori.

BRIEF SUMMARY OF THE INVENTION

In view of the above, it is an object of the present invention to provide a plaque for cremated remains which does not draw attention to its contents. Another object is to provide a receptacle into which a divided portion of the ashes in a zip bag may be placed by a funeral director or by the recipient without needing to touch the cremated remains. Other objects and features of the invention will be in part apparent and in part pointed out hereinafter.

In accordance with the invention, a memorial plaque for a divided part of the cremated remains in a zip bag of a person or pet includes a plate with a front face and a base. The front face is adapted to be custom personalized with a person or pet's name or other copy that make the plaque significant to a recipient and the base has a cavity formed in a rear surface and a cover. The cavity is constructed to receive the zip bag with the cover sealingly closing the cavity and being flush with the rear surface of the base.

In an embodiment of the invention, the base is a panel and the plate is mounted flat on the panel. In other embodiments, the base is a stand and the plate is mounted vertically on the stand. In some embodiments, the cover is recessed in a groove around the cavity and in yet other embodiments snap fittings are provided for latching the cover over the cavity. With all embodiments the cavity and cover face away from a viewer such that the memorial plaque does not draw attention to its contents or even to the fact that it has a compartment for contents, making it suitable for display in home or office.

The invention summarized above comprises the constructions and methods hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended t limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
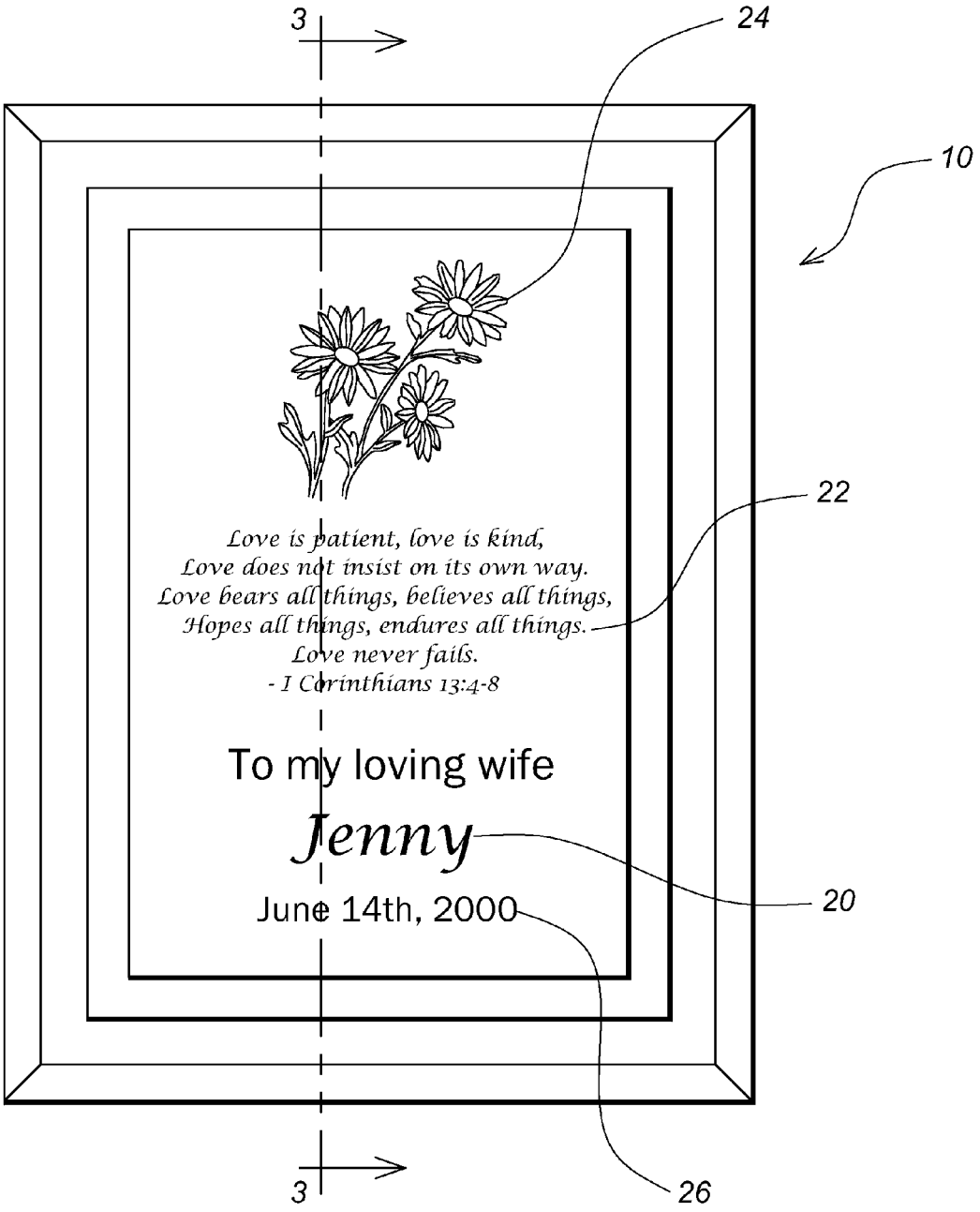
FIG. 1 is a front view of a first keepsake plaque in accordance with the present invention.
Figure 3:
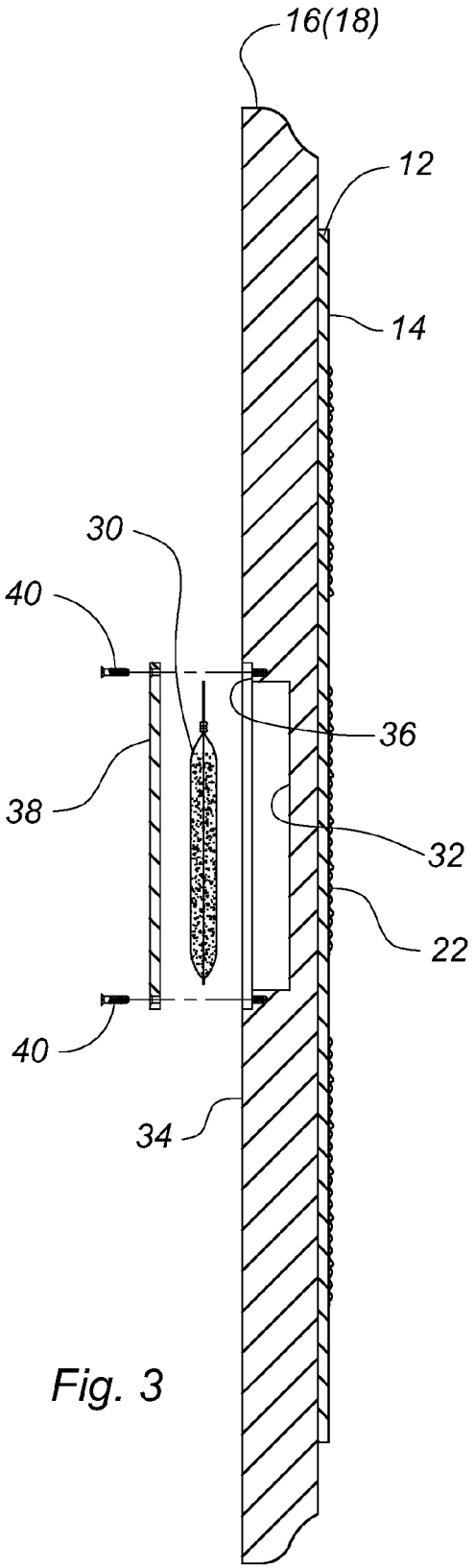
FIG. 3 is a exploded cross section taken along the plane of 3-3 in FIG. 1 showing a cavity for the zip bag which is sealingly closed with a cover, said cover received in a groove and attached with screws.

Referring to the drawings more particularly by reference character, reference numeral 10 refers to a keepsake plaque for cremated remains as shown in FIGS. 1 and 3.

Plaque 10 includes a plate 12 with a front face 14 mounted on a base 16 such as a panel 18. In the form illustrated in FIG. 1, front face 14 is adapted to be custom personalized with a person or pet's name 20 or other copy 22 that make the plaque significant to the recipient. Such copy 22 may include, for example, pictures, scenes, designs, identification information, script or other written information. As illustrated in FIG. 1, copy 22 consists of a quote from Corinthians and name 20 is that of the recipient's wife Jenny while design 24 is her favorite flower, daises. Addition text 26 such as a significant date, e.g., birth date, wedding date (Jun. 14, 2000), date of death, etc. may be displayed.

Panel 18 may be formed of a material different from the material from which plate 12 is formed. For example, plate 12 may be formed of glass or metal such as stainless steel, copper or the like and panel may be formed of wood, resin, metal or the like. Depending on the composition of plate 12, the personalized copy 22 including name, etc. may be applied to front face 14 using any known method such as printing, etching, laser etching, chemical etching, machining, milling, etc.

Figure 2:
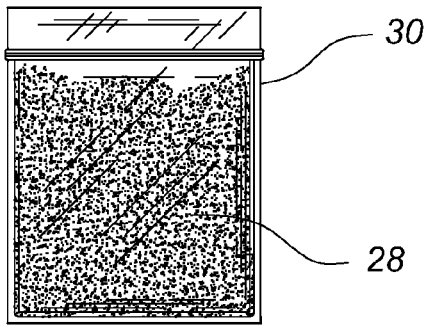
FIG. 2 is a plan view of a zip bag filled with about ¼ cup of cremated remains.

As shown in FIG. 2, a divided part of the cremated remains 28 is provided in a plastic zip bag 30 by a funeral director. For the present purpose, an amount of about 4 tablespoons or ¼ cup is sufficient (e.g., about 1 ounce) and a plastic zip bag 30 measuring about 2 by 2½ inches may be used. The amount of ash available for division depends on the size of the deceased person or pet but there is usually sufficient material for the funeral director to provide members of the family and friends who desire a portion with a divided part.

As shown in FIG. 3, a cavity 32 is formed on a back 34 of panel 18. Cavity 32 is rectangular in shape and configured for receipt of zip bag 30. A groove 36 is provided around cavity 32 such that a cover 38 may be received in groove 36 flush with the outer surface of back 34. Cover 38 may be translucent but is preferably opaque and may be formed of the same material as panel 18. Screws 40, glue or other fastening means may be used to secure cover 38 in groove 36 such that zip bag 30 is concealed from view and sealed in panel 18.

Figure 4:
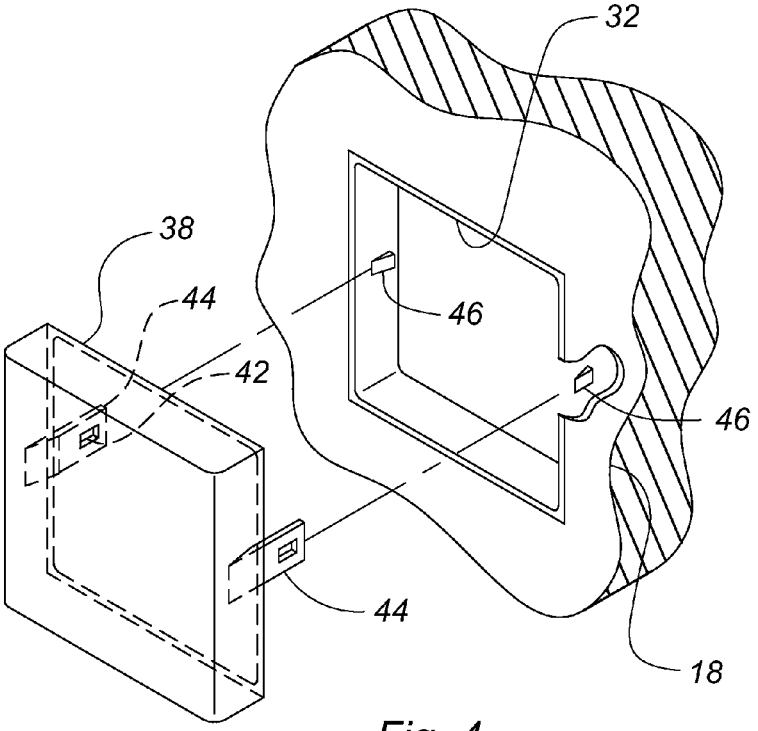
FIG. 4 is an exploded view of a snap fitting for sealingly closing the cavity with a cover.

Groove 36 may be omitted and cover 38 may be snap fitted in cavity 32, as illustrated in FIG. 4. As shown in FIG. 4, an aperture 42 is provided in legs 44 depending from cover 38 and tapered detents 46 are provided on the inside of cavity 32. As legs 44 are pushed into cavity 32, aperture 42 snaps over detents 46 securing cover 38 over cavity 32. Snap fittings are a common joining mechanism for plastic parts and any suitable snap fitting may be used in the present invention.

Figure 5:
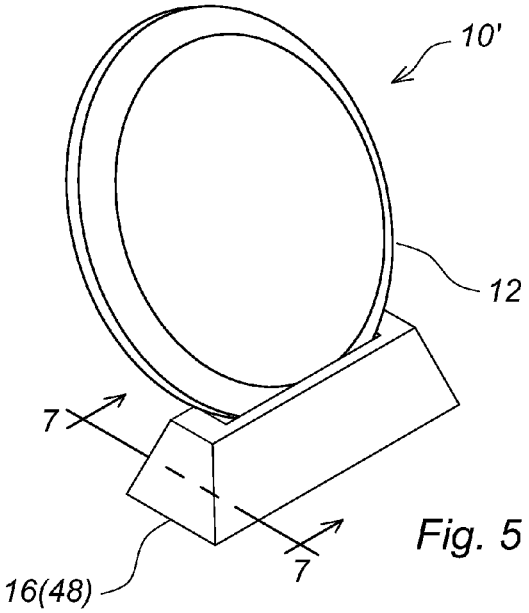
FIG. 5 is a perspective view of a second keepsake plaque in accordance with the present invention.
Figure 7:
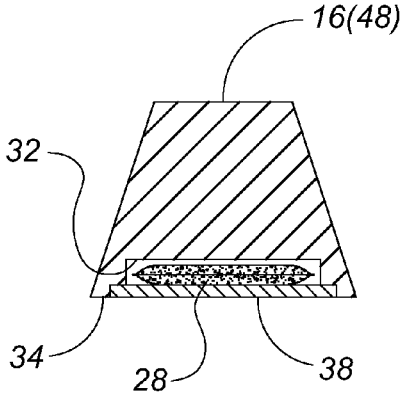

Rather than serving as a backing to plate 12, in keepsake plaque 10' as shown in FIG. 5, base 16 may be a stand 48. In this form, plate 12 may be formed or crystal and personalized as desired. Other materials may be used for plate 12 as discussed above and stand 48 may be formed of wood, metal, resin or the like. A cavity 32 as in panel 18 is formed in a back side or bottom of stand 48 which is sealed with a cover 38 as discussed above.

Figure 6:
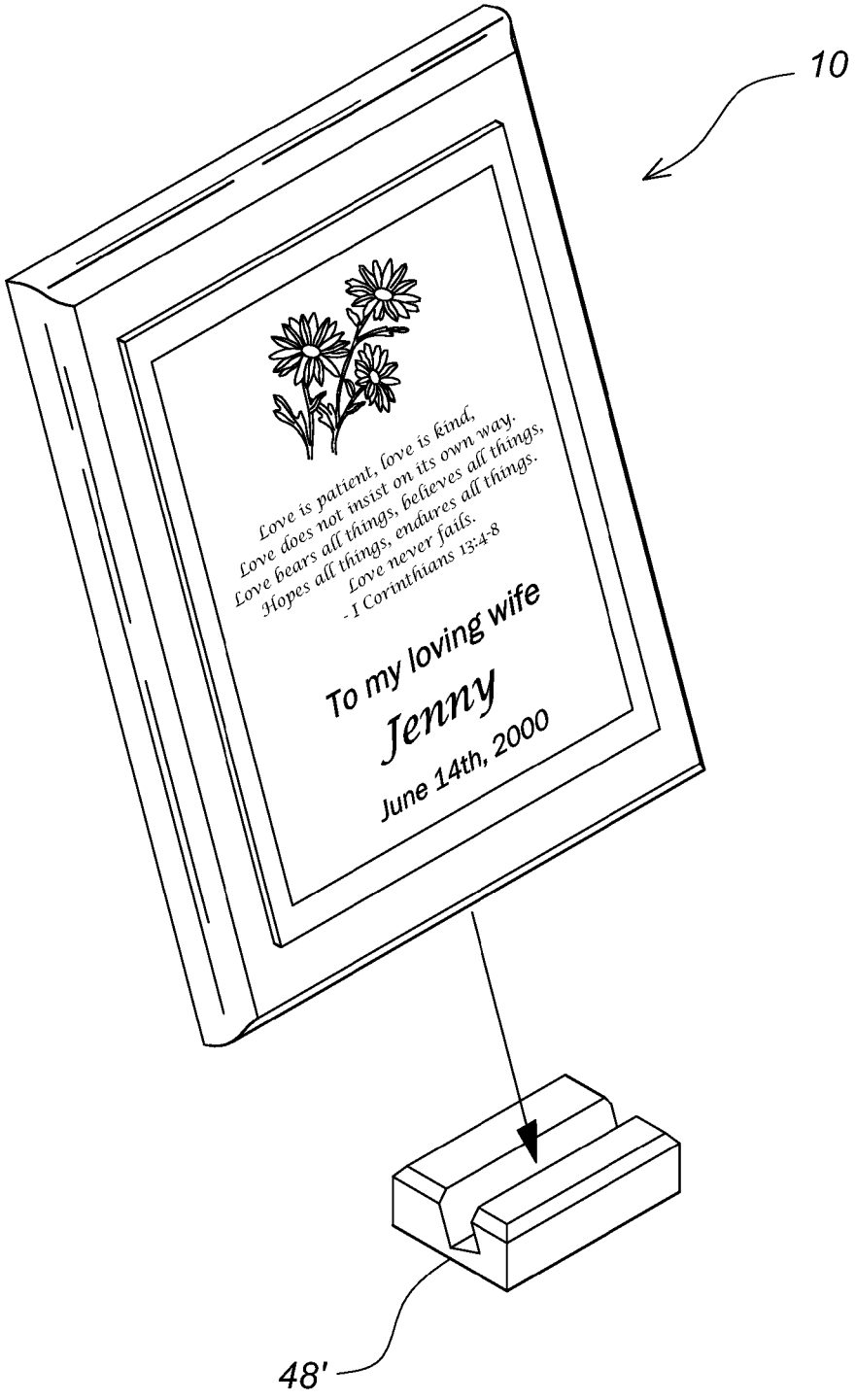
FIG. 6 is an exploded view of the first keepsake plaque and a stand for the plaque; and, FIG. 7 is a cross section taken along the plane of 7-7 in FIG. 5.

For use in celebrating the life of a deceased person or pet, a memorial plaque 10 is proposed by the funeral director for selection by the recipient. The recipient may and most likely will also selected the copy 22 to be applied to front face 14 of plate 12 appropriate to his or her relationship with the deceased. A divided part of the cremated remains 28 is placed in a zip bag 30. While placement of the remains in the bag could be done by the recipient, it is better done as a service by the funeral director. The zip bag 30 with the cremated remains is then inserted into cavity 32 and cover 38 attached with the appropriate attachment means. When base 16 is panel 18, memorial plaque 10 may be displayed on a wall in a home or office or displayed on a separate stand 48' as shown in FIG. 6 without drawing attention to the contents of the panel. In like manner with keepsake plaque 10', when base 16 is a stand 48 as shown in FIG. 5, plate 12 may be displayed without drawing attention to the contents of the base.

Discretion in display of cremated remains 28 is important as a body carries a mysterious infusion of the spiritual even after death. The memorial plaques 10 and 10' shown in FIGS. 1 and 5, respectively, allow the recipient to have a keepsake portion of the deceased's ashes nearby without upsetting others. It also allows each family member or friend to have a divided portion of the cremated remains as no more than 1 ounce is needed. To a visitor, memorial plaques 10 and 10' are just a kind reminder of the deceased's previous existence, without the unsettling spiritual presence.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

What is claimed:

1. A recognition award wall plaque for a divided part of the cremated remains of a person or pet in a flat zip bag comprising a plate with a front face mounted on a flat thin base, said base being hook free, said front face custom personalized with a person or pet's name or other copy that make the plaque significant to a recipient, said base having a cavity formed in a rear surface and a cover, said cavity sized for snug fitted receipt of the flat zip bag, said flat zip bag containing the divided part of the cremated remains received flatwise in said cavity, said cover sealingly closing the cavity and being flush with the rear surface of the base whereby when the plaque is hung upon a wall, the rear surface of the base is against the wall and the recognition award wall plaque does not draw attention to its contents.

2. The recognition award plaque of claim 1 wherein the plate is formed of wood, plastic, metal, glass or crystal.

3. A recognition award wall plaque for about 1 ounce forming a divided part of the cremated remains of a deceased person or pet in a flat zip bag comprising a flat thin base with a front face and a rear face, said base being hook free, said front face custom personalized with a person or pet's name or other copy that make the plaque significant to a recipient, a cavity formed in the rear face with a cover, said cavity sized for snug fitted receipt of the flat zip bag, the flat zip bag containing the divided part of the cremated remains received flatwise in said cavity, said cover sealingly closing the cavity and being flush with the rear face of the base whereby when the plaque is hung on a wall, the rear face is against the wall and does not draw attention to its contents.

4. The recognition award wall plaque of claim 3 wherein snap fittings are provided on the cover and cavity for sealingly closing the cavity with the cover.

5. The recognition award plaque of claim 3 wherein a groove is provided around the cavity into which the cover is received flush with the rear face.

6. The recognition award plaque of claim 3 wherein the cavity is constructed to receive the flat zip bag, said flat zip bag measuring about 2 by 2½ inches.

* * * * *